US006415535B1

(12) United States Patent
White et al.

(10) Patent No.: US 6,415,535 B1
(45) **Date of Patent: *Jul. 9, 2002**

(54) CIRCULATING FLUID AMUSEMENT DEVICE

(76) Inventors: Michael L. White; Patricia E. White, both of 9039 Danesbury Ct., Las Vegas, NV (US) 89123

( * ) Notice: Subject to any disclaimer, the term of this patent is extended or adjusted under 35 U.S.C. 154(b) by 0 days.

This patent is subject to a terminal disclaimer.

(21) Appl. No.: 09/903,118

(22) Filed: Jul. 10, 2001

Related U.S. Application Data

(63) Continuation of application No. 08/958,497, filed on Oct. 27, 1997, now Pat. No. 6,282,820.
(60) Provisional application No. 60/070,903, filed on Oct. 29, 1996.

(51) Int. Cl.[7] ..... G09F 19/00

(52) U.S. Cl. ..... 40/410; 40/406; 40/409; 40/426

(58) Field of Search ..... 40/406, 409, 410, 40/414, 423, 426; 446/138, 267

(56) References Cited

U.S. PATENT DOCUMENTS 6,282,820 B1 * 9/2001 White et al. ..... 40/410

* cited by examiner

*Primary Examiner*—J. J. Swann
*Assistant Examiner*—Andrea Chop
(74) *Attorney, Agent, or Firm*—Micheal L. White

(57) ABSTRACT

A fluid filled novelty amusement device with a magnetic impeller 9 driven by an electric motor 16, through a magnetic couple created between a magnetic rotor 15 and the magnetic impeller 9, that provides forced circulating fluid 3 flow that entrains and disperses ornamental particles 2 throughout a transparent enclosure 1 to provide viewing entertainment.

8 Claims, 1 Drawing Sheet

CIRCULATING FLUID AMUSEMENT DEVICE

BACKGROUND OF THE INVENTION

This application is a continuation of applicant's U.S. patent application Ser. No. 08/958,497 filed Oct. 27, 1997, now U.S. Pat. No. 6,282,820, which claims the benefit and right of priority conferred through prior U.S. Provisional Application No. 60/070,903 filed Oct. 29, 1996, and both these specifically enumerated applications are hereby incorporated herein by reference.

1. Field of the Invention

This invention relates to amusement devices used for entertainment and decoration that have a fluid filled transparent enclosure in which decorative particles can be suspended by fluid agitation and typically display a figurine within the enclosure.

2. Description of Related Art

At their most fundamental level these amusement devices (often termed snow globes, or water globes, among other variations), require manual shaking to disperse the decorative particles inside the fluid filled enclosure. However, the decorative particles settle to the bottom of the enclosure and the ornamental value of the device is soon lost. Almost constant manual agitation is required to maintain the ornamental effect of the particles swirling around the figurine. Consequently, the snow globe is usually displayed without particle movement, in a lack luster state. This does not set off the globe to its most aesthetic and interesting advantage.

Considerable inventive activity has been directed at the development of mechanical or electrical powered systems that aromatically disperse the decorative particles in these amusement devices. These improved devices have used mechanical and electrical motors to drive small pumps that agitate the enclosure fluid to disperse the decorative particles.

These patents include Murray (U.S. Pat. No. 5,313,727), Ingram (U.S. Pat. No. 5,491,916), Powell (U.S. Pat. No. 5,502,908), and Ong (U.S. Pat. No. 4,817,311).

The resultant continuous particle movement created by these improved devices creates a pleasing visual effect for both amusement and decoration without the need for manual agitation. Viewers enjoy a continuous visual display without resorting to what would otherwise require almost continuous manual agitation of the globe. The snow globe can always be presented in its most visually interesting and pleasing aesthetic state without the bother of manually agitating the device.

All of the above referenced patents, however, suffer from the same basic design flaw. All of these devices utilize a mechanical shaft to transmit power from the driver (e.g., electric motor or mechanical spring) to the pump. Because the shaft must protrude into the fluid filled snow globe to power the pump, all of the above patented devices suffer from the same problem, shaft leakage. Although the shaft is sealed with some sort of mechanical seal to prevent leakage, no mechanical seal can perfectly seal a fluid. Some leakage is always present because of the seepage that any seal will experience. Furthermore, this seal is eventually guaranteed to fail and leak catastrophically. These leaks occur because the seal wears, or the seal material degrades, or the seal becomes misaligned.

Because of the ornamental nature of snow globes, they are often displayed on wood furniture such as tables and cabinetry. In these vulnerable areas there is no allowable tolerance for leakage because of the water damage that will occur. Even the slight seepage that can be expected is too much moisture in these areas. None of the patents disclosed above has resolved this leakage problem.

SUMMARY OF THE INVENTION

This invention relates to a new and useful improvement in snow globes for the continuous circulation and dispersion of particles inside the globe. The greatest advantage of this invention is that a simple, economical method has been developed to provide a reliable leak proof seal. This invention improves upon the prior art with the application of a magnetic coupling of the drive mechanism to the pump.

The magnetic coupling allows the pump and all of the pump's components to be hermetically sealed from the drive mechanism. All other systems require a seal to accommodate a rotating shaft connecting the motor to the impeller. Such a seal will wear and eventually leak. In contrast, this invention does not require a seal because the fluid boundary is never breached. Leakage is impossible because there is no mechanical shaft penetrating the fluid boundary.

Another advantage of this invention over the prior art is that fewer and simpler components are required to make this invention operable. For example, the present invention requires neither a mechanical seal nor a drive shaft. Furthermore, none of the ancillary components required to couple the shaft to the drive and the impeller are required. As a result the assembly cost for the present invention is also reduced.

This invention dramatically changes the manner of use and display of traditional snow globes and similar amusement devices. In the past a snow globe required manual agitation to affect the desired display of falling snow (or other decorative particles). This new invention provides a constant display of circulating particles without the nuisance of providing constant manual agitation and without the fear that their globe will leak. Still further objects and advantages will become apparent from a consideration of the ensuing description and drawings.

DESCRIPTION OF THE PREFERRED EMBODIMENTS

Figure 1:
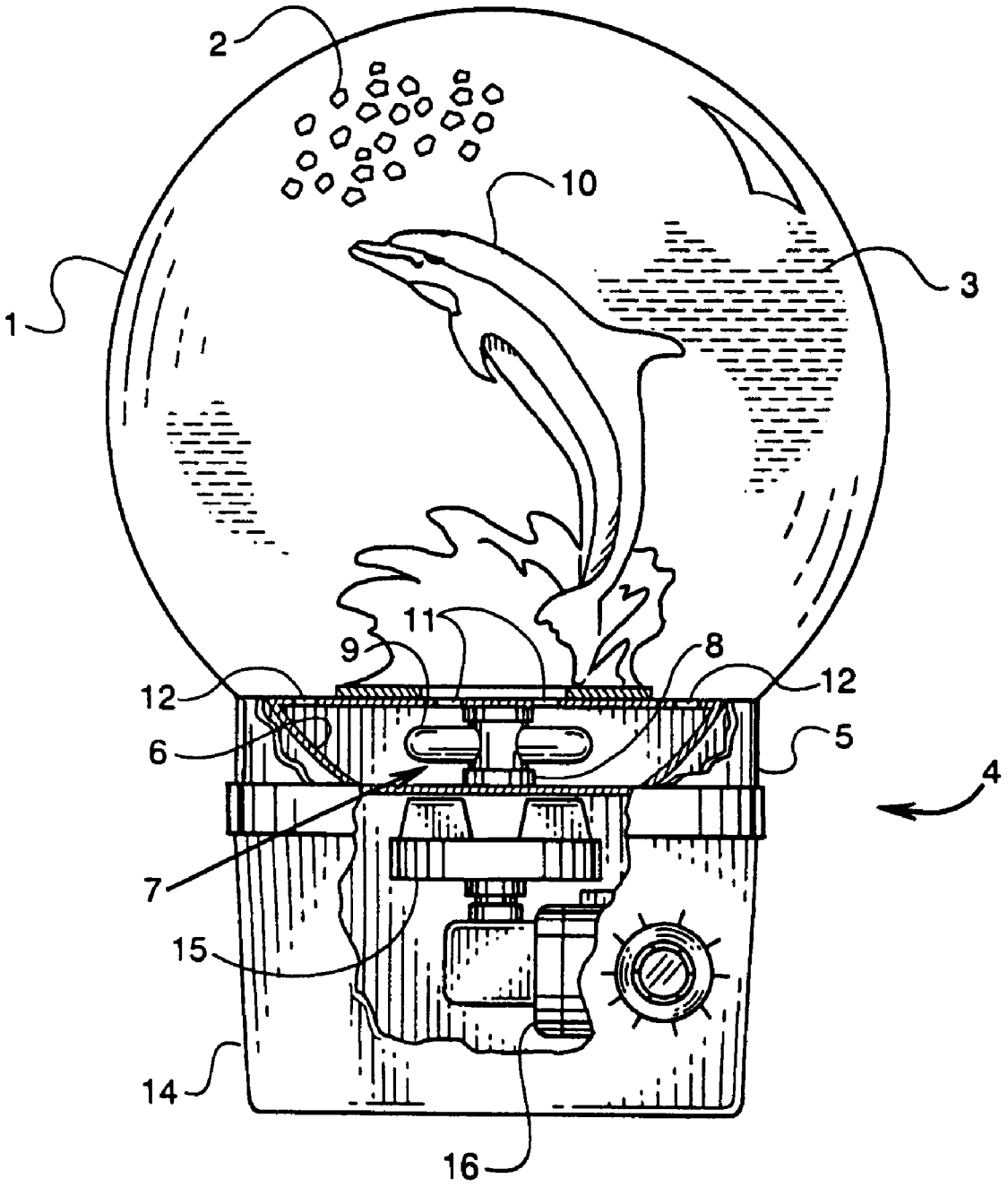
FIG. 1 is a front elevation view of a complete circulating fluid amusement device, and a cut away view depicting the magnetic drive mechanism powered by an electric motor.

A preferred embodiment of a circulating fluid amusement device of the present invention is illustrated in FIG. 1. The present invention has a fluid filled transparent enclosure 1 with a base 4 sealing the open end of the enclosure. The enclosure is typically made from plastic or glass. Disposed within the enclosure are decorative particles 2. These decorative particles typically have a snow like, or a metallic glitter-like appearance. The base consists of an upper housing 5 and a lower housing 14. The upper housing and the enclosure are in direct contact with the fluid.

The upper housing contains a magnetic impeller 9, suction ports 11, and discharge ports 12. The magnetic impeller 9 is rotatably mounted in the upper housing 5. The upper housing is hermetically sealed from the lower housing. The lower housing 14 contains the drive mechanism, including a magnetic rotor 15 with a north and a south magnetic pole, and a mechanical or electrical driver 16.

The present invention utilizes a magnetic drive of known design and is described in U.S. Pat. No. 4,162,855 to Bender.

Critical to the functionality of this device is the use of both a magnetic rotor and magnetic impeller. The magnetic rotor and the magnetic impeller are simply two separate magnets. Two magnets are required, otherwise, the coupling force between the rotor and impeller will be insufficient to transmit the required torque to obtain the necessary fluid velocities. Furthermore, unless both the impeller and rotor are magnets, the impeller will fall out of synchronization with the impeller. Because the impeller and the rotor are magnets, and have magnetic poles, any lack of synchronization is corrected as like poles repel, causing the rotor magnet to synchronize with the impeller magnet.

Consequently, the magnet 15 in the lower housing, and the magnet 9 disposed in the upper housing are magnetically coupled and aligned, allowing the rotating magnet 15 to transfer torque to the impeller 9 through the magnetic couple. The magnet 15 is connected to a shaft that allows the magnet to be rotated by the electrical driver 16, as depicted in FIG. 1.

In a preferred embodiment of this invention, an impeller assembly 7 may be used to rotatably mount impeller 9 (formed from a bar magnet). A rotatable hub 8 is substantially fixed in the horizontal and vertical planes to the upper housing. This impeller assembly is of known design as described by Bender in U.S. Pat. No. 4,162,855, issued Jul. 31, 1979. The major axis of the impeller 9 is mounted substantially in the horizontal plane through and affixed to the hub. This limits the horizontal and vertical movement of the hub 8 to ensure that the rotor 15 and the impeller 9 remain in alignment. The impeller may take on a variety of geometrical forms to achieve the greatest fluid pumping efficiencies. For example, the impeller can be hydrodynamically shaped to achieve greater energy conserving efficiencies.

The rotating impeller 9 centrifugally displaces fluid 3 through the discharge ports. This discharge fluid entrains the decorative particles 2 and circulates the particles upward from the base 4. Incoming fluid enters through the inlet suction port 11 leading to the center of the impeller 9. Centrifugally expelling the incoming fluid 3 through the discharge ports 12 completes the closed pumping cycle. FIG. 1 shows the typical circulating pattern of the fluid 3 and entrained particles 2 established by the impeller 9.

The radially outward flow created by the impellers centrifugal force can be more efficiently harnessed by including a flow deflector 6 in the upper housing that directs the substantially horizontal flow initially produced by the impeller to a substantially vertical flow. This reduces turbulence, maximizes laminar flow, and allows the device to operate more efficiently. In addition, with or without the flow straightener, the discharge ports can be altered and arranged to provide varied circulating flow patterns. For example, the discharge slots around the perimeter of the upper housing can be angled to provide a vortex flow pattern.

The ornamental elements commonly displayed inside the globe, such as a figurine, are attached above the upper housing inside the enclosure. The suction ports 11 and discharge ports 12 can be positioned to reduce the view of the intake slots and discharge ports. This preserves the aesthetic qualities of the displayed ornamentation.

Circulating fluid flow and particle entrainment commences when the drive mechanism is started. In the preferred embodiment the drive mechanism is an electric motor 16. A DC power source is optimal for this application because of the small motor size required. Low voltage DC power is also preferred because of safety concerns related to the use of electricity in proximity with water. This DC power source may be either from batteries or rectified AC current. Alternately, a mechanical spring may be used as the drive mechanism. The spring is wound to provide power to drive rotor 15. However, the duration of this power source is extemely limited in comparison to supplying either battery or household current to an electric motor. Consequently, the electric motor is the preferred drive mechanism.

The electric drive mechanism also allows the use of an electrical circuit to control the fluid flow. For example, an electrical circuit may be used to provide intermittent or pulsed operation. This will not only conserve energy, but will also provide greater variety in the various ornamental particle distributions that can be achieved. Such an electrical circuit can also be used to vary the fluid velocity within the globe to achieve various visual effects.

Although the discussion above contains many specifics, these should not be construed as limiting the scope of the invention but as merely providing illustrations of some presently preferred embodiments of this invention. Although a specific embodiment of the invention has been described and shown, it is apparent that some minor changes of structure and operation could be made without departing from the spirit of the invention as defined by the scope of the appended claims. Thus, the appended claims and their legal equivalents determines the scope of the invention, rather than the examples provided.

We claim:

1. An improved fluid filled amusement device that comprises:

a) an enclosure with an opening, said enclosure substantially transparent;

b) a fluid substantially filling said enclosure;

c) a base attached to said enclosure to seal said opening, said base having a first housing and a second housing, said first housing sealed from said second housing;

d) at least one suction port allowing fluid communication between said enclosure and said first housing;

e) at least one discharge port allowing fluid communication between said enclosure and said first housing;

f) a first magnet disposed in said first housing;

g) a second magnet rotatably mounted in said second housing, said second magnet closely spaced and aligned to said first magnet to form a magnetic couple; and h) a drive mechanism disposed in said second housing, said drive mechanism connected to said second magnet to rotate said second magnet.

2. An improved fluid filled amusement device as described in claim 1 further comprising a plurality of particles disposed in said enclosure.

3. An improved fluid filled amusement device as described in claim 1 wherein said first magnet is rotatably mounted in said first housing.

4. A method for circulating fluid in an amusement device comprising:

a. rotating a first magnet in a second housing with a drive mechanism connected to said first magnet;

b. forming a magnetic couple between said first magnet and a second magnet disposed in a first housing to cause said second magnet to rotate, said first housing sealed from said second housing, said first housing and said second housing forming a base;

c. suctioning fluid from a substantially transparent enclosure though an inlet port into said first housing; and d. pumping fluid from said first housing through an outlet port into said enclosure, said enclosure and said base connected together to form a fluid tight boundary.

5. A method as described in claim 4 further comprising entraining particles in said fluid.

6. An improved fluid filled amusement device that comprises:

a) an enclosure with an opening, said enclosure substantially transparent;

b) a fluid substantially filling said enclosure;

c) a base attached to said enclosure to seal said opening, said base having a first housing and a second housing, said first housing sealed from said second housing;

d) at least one suction port allowing fluid communication between said enclosure and said first housing; p1 e) at least one discharge port allowing fluid communication between said enclosure and said first housing;

f) an impeller disposed in said first housing, said impeller having a plurality of magnetic poles;

g) a rotor rotatably mounted in said second housing, said rotor having a plurality of magnetic poles, said rotor closely spaced and aligned to said impeller to form a plurality of magnetic couples; and h) a drive mechanism disposed in said second housing, said drive mechanism connected to said rotor.

7. An improved fluid filled amusement device as described in claim 6 wherein said impeller is rotatably mounted in said first housing.

8. An improved fluid filled amusement device as described in claim 6 further comprising a plurality of particles disposed in said enclosure.

* * * * *